US005942850A

United States Patent [19]

Rutan et al.

[11] Patent Number: 5,942,850

[45] Date of Patent: Aug. 24, 1999

[54] MINIATURE PROJECTION LAMP

[75] Inventors: Douglas M. Rutan, Auburn; Diane M. Salvati, Skaneateles; Timothy W. Graham, Union Springs, all of N.Y.

[73] Assignee: Welch Allyn, Inc., Skaneateles Falls, N.Y.

[21] Appl. No.: 08/935,473

[22] Filed: Sep. 24, 1997

[51] Int. Cl.[6] ..... H01J 17/20; H01J 61/12

[52] U.S. Cl. ..... 313/571; 313/574; 313/628; 313/638; 313/639; 313/640

[58] Field of Search ..... 313/571, 574, 313/628, 638, 639, 640, 641, 642

[56] References Cited

U.S. PATENT DOCUMENTS

| | | | |
|---|---|---|---|
| 4,594,529 | 6/1986 | De Vrijer | 313/571 |
| 4,884,009 | 11/1989 | Rothwell, Jr. et al. | 315/246 |
| 5,109,181 | 4/1992 | Fischer et al. | 313/639 |
| 5,451,838 | 9/1995 | Kawai | 313/638 |
| 5,691,601 | 11/1997 | Frey et al. | 313/571 |

*Primary Examiner*—Sandra O'Shea
*Assistant Examiner*—Michael J. Smith
*Attorney, Agent, or Firm*—Wall Marjama Bilinski & Burr

[57] ABSTRACT

A high performance miniature projection lamp which includes a glass envelope having a pair of opposite neck portions each with a coaxial central opening having a reduced section and an hermetically sealed central chamber having a volume of about 130 $mm^3$ which contains a fill. The fill includes an argon pressure at room temperature at a range of about 0.5 atmospheres to about 2.0 atmospheres and mercury in an amount in the range of about 5 mg to about 15 mg, and a mixture of metal halide material in an amount from about 50 up to 1000 micrograms. A pair of axially aligned electrodes are positioned at opposite neck portions and separated form each other by a predetermined distance. The electrodes each have a shank portion which each having a coil wrapped around its end.

14 Claims, 2 Drawing Sheets

MINIATURE PROJECTION LAMP

BACKGROUND OF THE INVENTION

The present invention relates in general to lamps, and more specifically to a high performance lamp which utilizes a light source which has a glass envelope having a critical size and design specifications.

It has long been a goal and objective in the field for a low wattage, long life, short arc gap lamp which could be used in front and rear projection applications. Changing needs of the marketplace have identified the need for a short arc gap lamp in the range of 50 watts. Such an illumination source would be required to illuminate small, approximately less than 1.5 inches, light valves. This source would require a miniature source size, high luminance, good color properties, long life and low power.

To date, none of the available prior art light sources can provide the combination of the necessary small arc gap, light output and long life in the miniature size required for the above-described applications.

Prior art general service, large area lighting, metal halide lamps have been designed with very long arc gaps which make them unsuitable for precise optical control of the emitted light. These general service lamps have been utilized in projection applications, but provide extremely inefficient and costly performance. Prior art low wattage lamps have shown that metal halide arc lamps with very small arc gaps, or electrode separations, can be designed to yield very effective optical coupling, but did not yield the very high brightness or exhibit acceptable long lifetimes. The present invention provides the advantage of maintaining a very small arc gap, excellent color as associated with metal halide type lamps, long service life, high luminous brightness and low power consumption.

It is therefore an object of the present invention to overcome the problems of the prior art described above.

It is a further object of the present invention to provide a high performance illumination or light source which can be used on compact miniature light valve projection systems.

It is a further object of the present invention to provide a high performance lamp for use in systems which require miniaturization and the advantages of increased portability and lower product cost.

It is yet another object of the present invention to provide a compact miniature light source which exhibits high luminance, good color properties and long life.

SUMMARY OF THE INVENTION

The present invention is directed to a high performance miniature arc lamp. The lamp has a preferred use as the key component in a projection display system that utilizes a reflector to focus light onto a miniature imaging device. The miniature imaging device can be any one of a number of available technologies such as liquid crystal displays, micro-electromechanized devices, or spatial light monitors. The miniaturization of these systems provides the advantages of increased portability and lower product cost.

For an illumination source to have utility to be used in compact, miniature light valve projection systems, it is essential that the lamp or illumination source be of an acceptable miniature size, exhibit high luminance, good color properties, long life and low power.

The lamp of the present is a unique combination of a critical envelope size and design in combination with critical fill parameters, and carefully controlled electrode design and specifications. This combination of components and specifications results in a high performance; miniature 50 watt projection lamp having a total output of >3,200 lumens; a color temperature of >5,000 K; and a maintenance of >75%; when using an electrode arc gap of 1.2 mm.

BRIEF DESCRIPTION OF THE DRAWING

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1A:
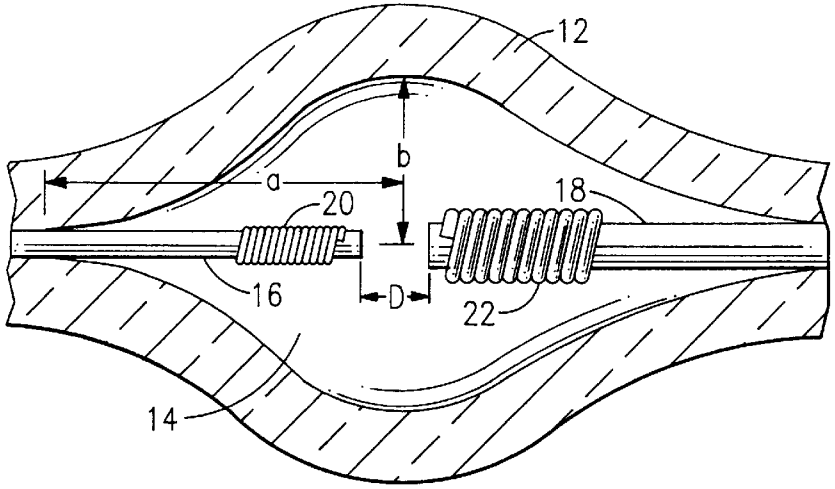
FIG. 1*a* is an enlarged sectional view of the hermetically sealed chamber of the light source shown in FIG. 1.
Figure 1:
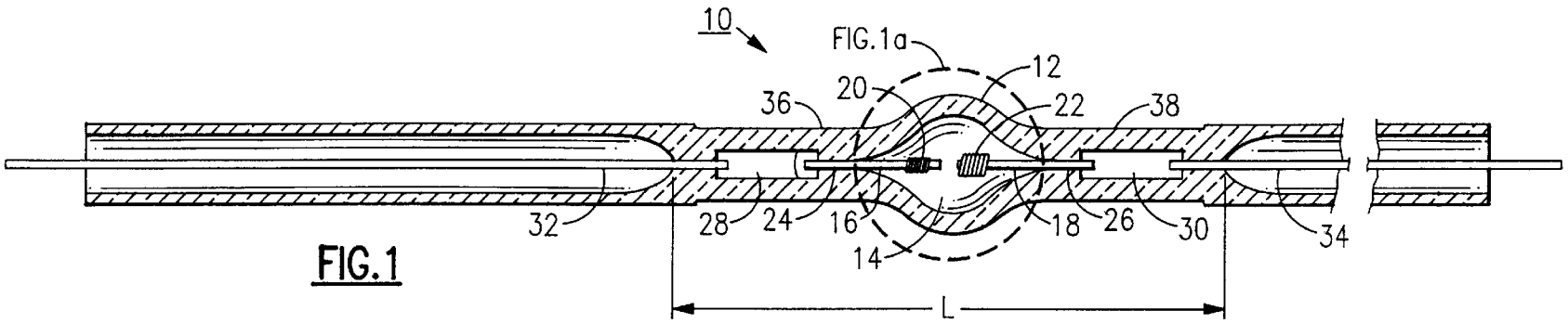
FIG. 1 is a side sectional view of the light source of the present invention.

The light source 10 of the present invention in the form of an elongated envelope is shown in more detail in FIG. 1 as being a double ended structure having a pair of elongated electrodes 16 (cathode) and 18 (anode) disposed at opposite ends of neck sections 36 and 38, respectively. The electrodes are separated from each other by a predetermined critical distance D or arc gap preferably in the range of about 0.8 mm to about 1.5 mm. The light source is in the shape of an elongated body having an overall length (L in FIG. 1) in the range of about 28 mm to about 32 mm having the neck sections with a diameter in the range of about 3 mm to about 5 mm, and has a generally ellipsoidal shaped central hermetically sealed chamber 12 having a volume 14 of about 130 $mm^3 \pm 20$ $mm^3$. The wall thickness of chamber 12 is about 1 mm. The light source contains a critical fill mix which comprises an inert noble gas, mercury and metal halides.

More specifically, the sealed chamber is formed such that it is approximately ellipsoidal in shape with an internal volume that optimally determines the total internal gas pressure given the quantity of fill material and operating power.

The volume can be approximated to that of an ellipsoid of semi-major axis, a, and semi-minor axis, b.

$$V = \tfrac{4}{3}\pi b^2 a$$

The semi-major axis length (a in FIG. 1*a*) for the light source of the present invention is one half of the overall chamber length and in a range of about 4 to 6 mm. The semi-minor axis length (b in FIG. 1*a*) is one half of the chamber inner diameter and has a range of about 2 to 3 mm.

The preferred range of the chamber volume to yield optimal performance specifications is about 110 to 150 $mm^3$. The lamp power divided by the chamber volume is known as the volume-power loading of the lamp. This number calculates out to be $0.4/mm^3$ given the preferred range of design factors. This metric is significant because it relates to the amount of heat dissipated per unit size of the lamp and therefore influences the operating temperature of the lamp.

The appropriate volume of the chamber is determined in combination with other interrelated design factors, primarily the type and amount of fill materials and operating power.

Deviation from the optimal volume could lead to performance degradation as a result of either improper internal operating pressure or improper thermal operation as dictated by the volume-power loading.

The electrodes respectively consist of a shank portion the ends of which contain wrapped metal coils 20 and 22, respectively. Proper thermal and electrical design of electrodes are required to achieve the desired performance. Coils, or wraps of wire, around the primary electrode shank can be added to properly balance the electrical and thermal requirements. Coils can serve the function of providing an additional thermal radiative surface to control the temperature of the electrode shank. The size and length of the coil can be designed to achieve optimal thermal performance. An additional function of coils is to provide the appropriate electrical field properties for efficient and reliable arc initiation, or lamp starting. In certain applications, the coil on the cathode is optional and is not required. The opposite end of the shank portions are respectively connected to one end of a foil member 28 and 30 respectively sealed in the opposite end of the neck portion. Typically, the foil members are made of molybdenum. The foil members have their other end respectively connected to relatively thicker outer lead wires 32 and 34 which in turn are respectively connected to the structural members shown more clearly in FIG. 2.

Figure 2:
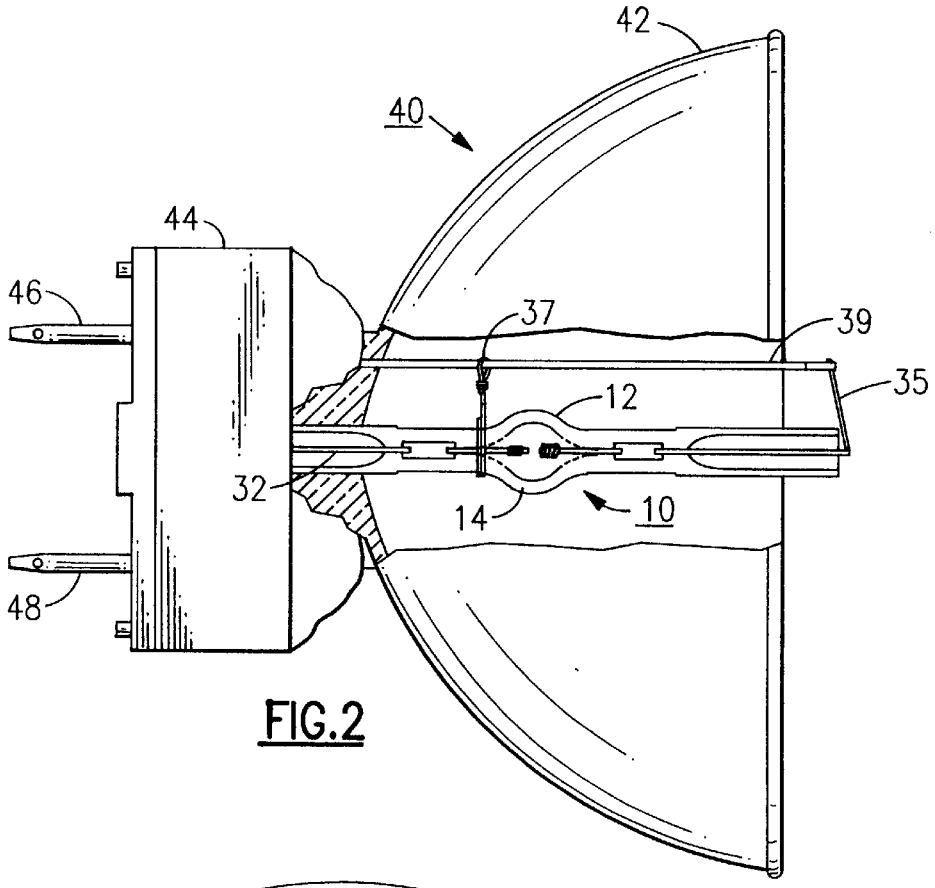
FIG. 2 is a side sectional view of a lamp containing the light source of FIG. 1.
Figure 3:
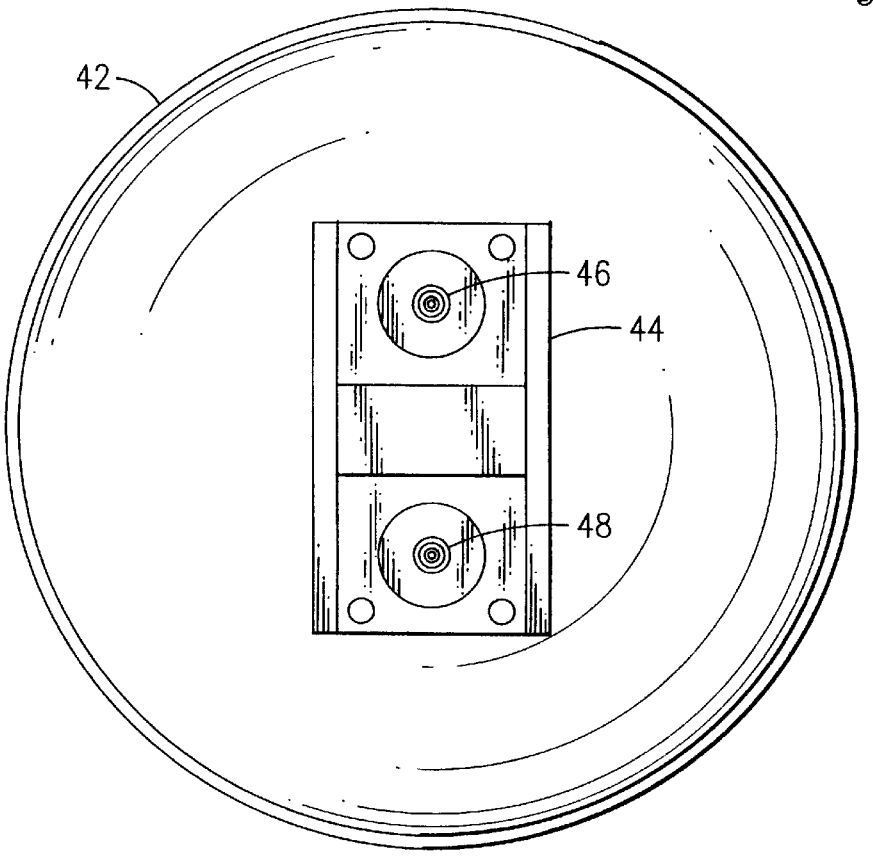
FIG. 3 is a rear view of the lamp shown in FIG. 1.

FIG. 2 illustrates the miniature projection lamp 40 of the present invention which includes a reflector 42 containing the light source 10 having an insulating thermally resistant connector 44 having a pair of pins 46 and 48 suitable for connection to a suitable source of power. Structural members 35, 37 and 39 are used to orient the light source in a substantial horizontal axis with respect to the reflector and form the electrical connections along with lead wire 32.

In the present invention, a refractory insulating material is formed into an elongated envelope into which the following components are inserted and hermetically sealed:

a. a pair of refractory metal electrodes;

b. a quantity of metal halide material;

c. a quantity of metallic mercury; and d. a quantity of an inert noble gas.

The electrodes are aligned in an axial manner facing each other. The light source is operated in a direct current (DC) mode at a low electrical power.

Refractory materials for the envelope can be fused silica or alumina oxide. The refractory materials for the electrodes typically are tungsten (with or without thorium) or molybdenum. The description of electrodes is defined in more detail below. The metal halide materials and quantity of mercury is also described below.

Preferably the envelope material is fused silica and the electrodes are tungsten. Fused silica is easier to handle and process, and tungsten allows for higher operating temperatures and increases light output and life.

The opposing electrodes are set apart and separated at a distance to provide optimal performances for projection display applications. Maximum utilization of optical component light collection requires the light source to be as near to "point source" as possible.

The broad range of separation is 0.8 mm to 1.5 mm.

The preferred range of separation is 1.2 mm±0.2 mm.

Falling below the preferred range of separation will cause a corresponding loss in lamp luminous efficacy. Exceeding the preferred range will minimize the effectiveness of the lamp as a miniature source for projection optics.

In operating the light source in a DC mode, one electrode is identified as the anode, the other as the cathode, and each is sized appropriately for optimal operation for a given lamp power and current. The electrodes are constructed from known techniques that incorporate an overwound refractory metal coil attached to the metal shank. The optimal design is determined given the range of electrical power and current over which the source is intended to operate. The table below tabulates the electrode wire diameters and power and current ranges for the present invention.

| | Range of Wattage: 40 W–60 W Range of Current: 0.5 A–1.5 A | Preferred Wattage: 50 W ± 2 W Preferred Current: 0.9 A ± .2 A |
|---|---|---|
| Anode Shank | 0.020 in. ± 0.008 in. | 0.020 in. ± 0.001 in. |
| Anode Overwind Wire | 0.010 in. ± 0.005 in. | 0.010 in. ± 0.001 in. |
| Cathode Shank | 0.014 in. ± 0.004 in. | 0.014 in. ± 0.001 in. |
| Cathode Overwind Wire | 0.005 in. ± 0.005 in. | 0.007 in. ± 0.001 in. |

A mismatch between electrical operating characteristics and electrode design could be disastrous from a product performance standpoint. Generally, a design that permits too high of an operating temperature of the electrodes (high current/small electrodes) will result in rapid electrode erosion, darkening of the envelope, short life and low light output. Too low of an operating temperature of the electrode (low power/large electrodes) will result in an unstable or flickering arc.

The metal halide material is a mixture of individual compounds selected from the following list which includes but is not limited to cesium iodide, indium iodide, lithium iodide, scandium iodide, sodium iodide, and thalium iodide, in amounts ranging from about 50 to 1000 micrograms.

The preferred mixtures comprise a combination of sodium iodide—indium iodide-scandium iodide, or sodium iodide-indium iodide-scandium iodide- thalium iodide in the amounts of 250 to 300 micrograms.

The proper mixtures are combined to yield a high luminous efficacy of on the order of 60 lumens per watt while maintaining the proper source apparent color temperature of about 5,000 K to 6,000 K. Color balance of the spectral output is achieved utilizing the preferred ranges and provide the red, green and blue colors needed for proper color projection.

The quantity of mercury is added such that it will evaporate and enter the discharge in a gaseous state and regulate the electrical operational parameters.

The amount of mercury can range from 5 to 15 milligrams and is a function of the internal volume of the envelope.

The preferred amount being about 9 milligrams±−10%.

Excess mercury will cause excess pressure within the bulb and could result in early failure. Too low of an amount of Hg could result in improper electrical operating characteristics, primarily thereby reducing luminous efficacy.

The fill inert gas is added to provide a gas that can be ionized to aid in the starting of the lamp. Suitable fill gasses include Ne, Ar, Kr, and Xe with cold fill pressures in the range of 0.5 atm to several atmospheres.

A preferred gas for use in the present invention is Ar at about 500 Torr±2%. Excess Ar would cause the required voltage to initiate the discharge to be very high and impose large costs on the electrical operating circuitry.

The above specification for the electrode arc gap, quantity of metal halide, mercury, and noble gas must be used in conjunction with an hermetically sealed chamber having a critical volume, which in the case of the present invention is about 130 $mm^3$±20 $mm^3$.

The performance of the light source is characterized as having high luminous efficacy, high color temperature as required for color critical projection display applications, miniature source size, and long service life.

The range of luminous efficacies are to exceed 60 lpw. The color temperature can be controlled through selection of metal halide mixtures in a range of 3,000 K to 9,000 K. The source size is dictated by the electrode separation (arc gap) in the range of 0.8 mm to 1.5 mm. The overall length of the envelope and associated structure being about 2 inches long. The service life exceeding 2,000 hrs.

The preferred performance specifications as demonstrated are luminous efficacies greater than 64 lpw, Color temperature of 4,000 K–6,000 K, electrode separation of 1.0 mm to 1.4 mm and service lifetimes exceeding 2,000 hours.

The light source and lamp of the present invention are manufactured by conventional well known methods known to the art.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A high performance miniature projection lamp comprising:

an elongated glass envelope having a pair of opposite neck portions each with a coaxial central opening having a reduced section and a central hermetically sealed chamber having a volume of about 130 $mm^3 \pm 20$ $mm^3$ containing a fill comprising;

(a) an argon pressure at room temperature at a range of about 0.5 atmospheres to about 2.0 atmospheres; mercury in an amount in the range of about 5 mg to about 15 mg; a mixture of metal halide material in an amount from about 50 up to 1000 micrograms; and (b) a pair of axially aligned electrodes respectively positioned at said opposite neck portions and separated from each other by a predetermined distance from about 0.8 to 1.5 mm, said electrodes each having a shank portion which includes a distal end, with at least one of said ends having a coil wrapped around said end.

2. The lamp of claim 1 in which the distance between the electrodes is about 1.2 mm.

3. The lamp of claim 1 in which the argon pressure is about 500 Torr.

4. The lamp of claim 1 in which the amount of mercury is about 9 mg.

5. The lamp of claim 1 in which the metal halide comprises a combination of sodium iodide-indium iodide-scandium iodide, or sodium iodide-indium iodide-scandium iodide-thalium iodide, in the amounts from about 250 to 300 micrograms.

6. A high performance miniature projection lamp comprising:

a fused silica envelope having a pair of opposite neck portions each with a coaxial central opening having a reduced section and a central hermetically sealed chamber having a volume of about 130 $mm^3 \pm 20$ $mm^3$ containing a fill comprising;

(a) an inert noble gas pressure at room temperature in the range of about 0.5 atmospheres to about 2.0 atmospheres; mercury in an amount in the range of about 5 mg to about 15 mg; a mixture of metal halide material in an amount from about 50 up to 1000 micrograms; and (b) a pair of refractory metal axially aligned electrodes respectively positioned at said opposite neck portions and separated from each other by a predetermined distance of about 0.8 to 1.5 mm.

7. The lamp of claim 6 in which the distance between the electrodes is about 1.2 mm.

8. The lamp of claim 6 in which the inert noble gas is selected from the group consisting of Ne, Ar, Kr and Xe.

9. The lamp of claim 6 in which the inert noble gas is argon, and the argon pressure is about 500 Torr.

10. The lamp of claim 6 in which the amount of mercury is about 9 mg.

11. The lamp of claim 6 in which the metal halide comprises a combination of sodium iodide-indium iodide-scandium iodide, or sodium iodide-indium iodide-scandium iodide-thalium iodide, in the amounts from about 250 to 300 micrograms.

12. A high performance miniature projection lamp comprising:

a fused silica envelope having a pair of opposite neck portions each with a coaxial central opening having a reduced section and a central hermetically sealed chamber in the general shape of an ellipsoid having a volume of about 130 $mm^3 \pm 20$ $mm^3$ containing a fill comprising;

(a) an argon pressure at room temperature of about 500 Torr; mercury in an amount in the range of about 5 mg to about 15 mg; a mixture of metal halide material in a concentration of about 250 to 300 micrograms; and (b) a pair of tungsten electrodes respectively positioned at said opposite neck portions and separated from each other by a distance of about 0.8 to 1.5 mm, said electrodes each having a shank portion which includes a distal end, with at least one of said ends having a refractory metal coil wrapped around said end.

13. The lamp of claim 12 in which the metal halide comprises a combination of sodium iodide-indium iodide-scandium iodide, or sodium iodide-indium iodide-scandium iodide-thalium iodide, in the amounts from about 250 to 300 micrograms.

14. The lamp of claim 12 in which the overall length of the envelope and associated structure is about two inches long and the lamp exhibits the following performance specifications:

| | |
|---|---|
| Wattage | 50 watts |
| Total Output | >3,200 Lumens |
| Median Life | 4,000 Hours |
| Color Temp. | >5,000 K. |
| Maintenance | >75% |
| Arc Gap | 1.2 mm |

* * * * *